US009435064B2

(12) United States Patent
Kim et al.

(10) Patent No.: US 9,435,064 B2
(45) Date of Patent: Sep. 6, 2016

(54) LIFTER AND DRYING MACHINE HAVING THE SAME

(71) Applicant: SAMSUNG ELECTRONICS CO., LTD., Suwon-si (KR)

(72) Inventors: Young Jae Kim, Seoul (KR); Nu Ri Shin, Seongnam-si (KR); Myung Won Jeon, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 147 days.

(21) Appl. No.: 14/087,647

(22) Filed: Nov. 22, 2013

(65) Prior Publication Data

US 2014/0137425 A1 May 22, 2014

(30) Foreign Application Priority Data

Nov. 22, 2012 (KR) ..... 10-2012-0132924

(51) Int. Cl.
*D06F 58/20* (2006.01)
*D06F 37/06* (2006.01)
*D06F 58/04* (2006.01)

(52) U.S. Cl.
CPC ..... *D06F 37/06* (2013.01); *D06F 58/04* (2013.01); *Y10T 29/49947* (2015.01)

(58) Field of Classification Search
CPC ..... F26B 11/00; F26B 11/10; F26B 21/00; A45D 20/00; A45D 20/20; D06F 37/00; D06F 58/00; D06F 58/20
USPC ..... 34/595, 601, 606, 610; 68/19, 20; 8/149.3, 158
See application file for complete search history.

(56) References Cited

U.S. PATENT DOCUMENTS

| | | | | | |
|---|---|---|---|---|---|
| 2,082,108 | A | * | 6/1937 | Hume | 68/23.5 |
| 2,816,742 | A | * | 12/1957 | Richterkessing et al. | 366/228 |
| 2,851,791 | A | * | 9/1958 | Olthuis | 34/90 |
| 3,402,576 | A | * | 9/1968 | Krupsky | 68/4 |
| 3,512,268 | A | * | 5/1970 | Bilson et al. | 34/108 |
| 3,748,746 | A | * | 7/1973 | Robandt | 34/82 |
| 3,811,202 | A | * | 5/1974 | Arendt | 34/599 |
| 4,109,397 | A | * | 8/1978 | Daily | 34/239 |
| 4,617,743 | A | * | 10/1986 | Barnard | 34/109 |
| 4,702,016 | A | * | 10/1987 | Grigsby et al. | 34/499 |
| 5,371,956 | A | * | 12/1994 | St. Louis | 34/599 |
| 5,724,751 | A | * | 3/1998 | Ellingsen | 34/354 |
| 5,743,025 | A | * | 4/1998 | Jordan, Jr. | 34/600 |

(Continued)

FOREIGN PATENT DOCUMENTS

| | | |
|---|---|---|
| KR | 10-2005-0088611 | 9/2005 |
| KR | 10-2007-0115300 | 12/2007 |

*Primary Examiner* — Steve M Gravini
(74) *Attorney, Agent, or Firm* — Staas & Halsey LLP

(57) ABSTRACT

A drying machine has a cabinet, a drying drum disposed at an inside the cabinet to accommodate a laundry, and configured to rotate by receiving rotating force from a driving source, and at least one lifter provided at an inner circumferential surface of the drying drum, and configured to have the laundry move at an inside the drying drum. the at least one lifter includes at least one coupling boss part configured to be coupled to the drying drum, and at least one guide rib protrudedly provided to pass through the drying drum so as to temporarily couple the at least one lifter to the drying drum, so that the adhesiveness is increased at the time of assembling the at least one lifter to the drying drum, thereby preventing the vibration and water leakage during rotation of the drying drum.

24 Claims, 10 Drawing Sheets

(56) References Cited

U.S. PATENT DOCUMENTS

| | | | | |
|---|---|---|---|---|
| 5,901,465 | A * | 5/1999 | Boussetta | D06F 58/04 34/242 |
| 6,067,723 | A * | 5/2000 | Lafrenz | 34/61 |
| 6,115,936 | A * | 9/2000 | Arlie | 34/61 |
| 6,134,810 | A * | 10/2000 | Stockley | 34/600 |
| 6,401,362 | B1 * | 6/2002 | Schultz et al. | 34/499 |
| 6,971,189 | B1 * | 12/2005 | Anibas | 34/602 |
| 7,194,824 | B2 * | 3/2007 | Wang | 34/602 |
| 7,841,800 | B2 * | 11/2010 | Gracia Bobed | 403/274 |
| 7,946,057 | B2 * | 5/2011 | Dittmer et al. | 34/603 |
| 8,042,282 | B2 * | 10/2011 | Oh et al. | 34/595 |
| 8,065,816 | B2 * | 11/2011 | Ricklefs et al. | 34/602 |
| 8,347,523 | B2 * | 1/2013 | Chung | 34/130 |
| 8,661,707 | B2 * | 3/2014 | Dittmer et al. | 34/606 |
| D713,105 | S * | 9/2014 | Reger et al. | D32/25 |
| 2005/0126034 | A1 * | 6/2005 | Jeong et al. | 34/602 |
| 2013/0213097 | A1 * | 8/2013 | Kim et al. | 68/140 |
| 2014/0137425 | A1 * | 5/2014 | Kim et al. | 34/108 |

* cited by examiner

LIFTER AND DRYING MACHINE HAVING THE SAME

CROSS-REFERENCE TO RELATED APPLICATIONS

This application claims the priority benefit of the Korean Patent Application No. 10-2012-0132924, filed on Nov. 22, 2012, in the Korean Intellectual Property Office, the disclosure of which is incorporated herein by reference.

BACKGROUND

1. Field

The following description relates to a drying machine provided with a lifter to ascend and descend laundry at an inside a drying drum.

2. Description of the Related Art

In general, a clothes drying machine is an apparatus configured to dry a substance, which is to be dried, put in a drying drum, by forcedly blowing heated air by a blower to an inside the drying drum. The clothes drying machine as such is similar to a drum type washing machine in terms of an exterior appearance, and the drying machine is provided at an inside thereof with a filter member configured to filter foreign substance being delivered from the drying drum.

At an inner circumferential surface of the drying drum, a plurality of lifters are provided to ascend and descend laundry when the drying drum is rotated, so that the laundry makes contact with dry air.

The plurality of lifters enable laundry to move at the time of the drying drum is rotated such that the laundry makes contact with dry air, thereby enhancing the drying efficiency of the laundry.

A conventional lifter is temporarily coupled to the drying drum and is mounted at an inner circumferential surface of the drying drum by use of a connecting member such as a screw. In the case when using the connecting member as such, the time period of the lifter being coupled is extended, and due to the cost of the connecting member, the price of the drying machine is increased as a whole, and since the coupling is performed through the connecting member after the temporary coupling is proceeded, as to prevent a leak from a boss portion of the temporary coupling, an inconvenience of attaching a separate sheet member to an outer circumferential surface of the drying drum is present.

SUMMARY

Therefore, it is an aspect of the present disclosure to provide at least one lifter configured to be coupled to a drying drum by use of a connecting member such as a screw after fixing the at least one lifter to the drying drum through a temporary coupling prior to coupling the at least one lifter to the drying drum, and a drying machine having the same.

Additional aspects of the disclosure will be set forth in part in the description which follows and, in part, will be obvious from the description, or may be learned by practice of the disclosure.

In accordance with one aspect of the present disclosure, a drying machine includes a cabinet, a drying drum and at least one lifter. The drying drum may be disposed at an inside the cabinet to accommodate a laundry, and configured to rotate by receiving rotating force from a driving source. The at least one lifter may be provided at an inner circumferential surface of the drying drum, and configured to have the laundry move at an inside the drying drum. The at least one lifter may include at least one coupling boss part configured to be coupled to the drying drum; and at least one guide rib protrudedly provided to pass through the drying drum so as to temporarily couple the at least one lifter to the drying drum.

The at least one guide rib may be provided in a shape of a taper.

The at least one guide rib may be protrudedly formed to be temporarily coupled to the drying drum while being inserted into the drying drum prior to the at least one coupling boss part.

The at least one guide rib may be provided in the shape of an arc of the at least one coupling boss part to cover a predetermined radius of the at least one coupling boss part.

The at least one guide rib may be further protruded than the at least one coupling boss part.

The at least one guide rib may include a guide rib inner surface part that makes contact with a predetermined radius of the at least one coupling boss part, and a guide rib outer surface part having a cross-section perpendicular to a longitudinal direction of the at least one guide rib in an arc shape and being inclined toward the at least one coupling boss part with respect to a protruded direction of the at least one guide rib.

The at least one guide rib may further include a guide rib side surface part connecting the guide rib inner surface part to the guide rib outer surface part.

The at least one guide rib may include a first guide rib and a second guide rib, and the first guide rib and the second guide rib are disposed while being spaced apart from each other along a longitudinal direction of the at least one lifter.

The first guide rib and the second guide rib may be disposed at opposite sides to each other with respect to a center of the at least one lifter.

The first guide rib and the second guide rib may be respectively disposed at end portions of the at least one lifter in a longitudinal direction of the at least one lifter.

The at least one coupling boss part may be spaced apart from each other in a longitudinal direction of the lift, starting from a middle of a width direction of the at least one lifter.

The drying drum may be provided with a fixation hole to be coupled to the at least one lifter.

The fixation hole may include a first fixation hole to which the at least one guide rib is coupled, and a second fixation hole to which the at least one coupling boss part is coupled.

In accordance with another aspect of the present disclosure, a drying machine includes a cabinet and a drying drum. The drying drum may be disposed at an inside the cabinet, and configured to rotate by receiving rotating force from a driving source. The drying drum may include a cylindrical part and at least one lifter. The at least one lifter may be formed at an inner circumferential surface of the cylindrical part in a direction parallel to a driving shaft so as to have laundry move according to a rotation of the drying drum. The at least one lifter may include at least one coupling boss part, at least one guide rib and a first fixation hole. The at least one coupling boss part may be configured to be coupled to the drying drum. The at least one guide rib may be protrudedly provided to pass through the drying drum while being integrally formed with one side of at least one coupling boss part so as to temporarily couple the at least one lifter to the drying drum. The first fixation hole may be provided at the cylindrical part for coupling of the at least one coupling boss part and for temporary fixing of the at least one guide rib.

The drying machine may further include a second fixation hole configured for the coupling of the at least one coupling boss part.

The first fixation hole and the second fixation hole may be disposed in alignment with each other on the cylindrical part.

The first fixation hole and the second fixation hole may be alternately disposed on the cylindrical part.

The first fixation hole and the second fixation hole may be disposed at different sizes from each other.

The at least one guide rib may be provided in a shape of an arch of the at least one coupling boss part to cover a predetermined radius of the at least one coupling boss part.

The at least one guide rib may be further protruded than the at least one coupling boss part.

The at least one guide rib may include a guide rib inner surface part and a guide rib outer surface part. The guide rib inner surface part may make contact with a predetermined radius of the at least one coupling boss part. The guide rib outer surface part may have a cross-section perpendicular to a longitudinal direction of the at least one guide rib in an arc shape, and be inclined toward the at least one coupling boss part with respect to a protruded direction of the at least one guide rib.

The at least one guide rib may further include a guide rib side surface part connecting the guide rib inner surface part to the guide rib outer surface part.

The first fixation hole may include a locking connection part and a coupling connection part. The locking connection part may come into close contact with the at least one lifter to fix the at least one lifter. The coupling connection part may come into close contact with the drying drum while allowing the at least one coupling boss part to be coupled thereto.

The locking connection part may be provided in a shape of an arc to come into close contact with the guide rib outer surface part.

The at least one coupling boss part may be screw-coupled while coming into close contact with the coupling connection part.

At least one lifter of the present disclosure and a drying machine having the same are capable of easily coupling at least one lifter to an inside a drying drum of the drying machine, and in the case of a coupling, without having to place separate time and effort to fix the at least one lifter to the inside the drying drum of the drying machine, the at least one lifter may be fixed to the at least one lifter to the inside the drying drum of the drying machine. In addition, a sheet is not needed to be attached as to separately prevent a leaking with respect to the temporary fixing portion, and thus the material and cost of manufacturing may be reduced.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
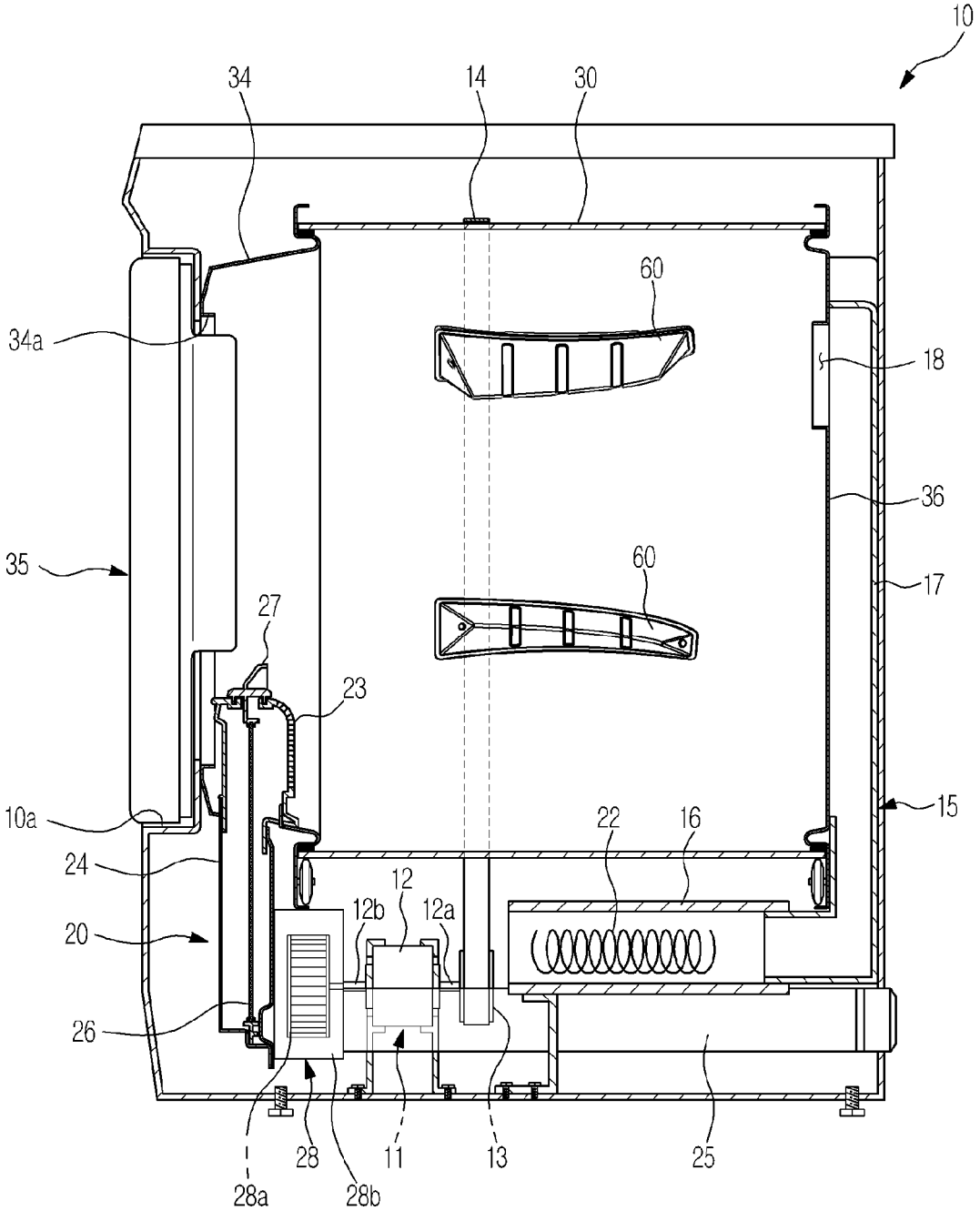
FIG. 1 is a cross-sectional view of a drying machine in accordance with an embodiment of the present disclosure.

Reference will now be made in detail to embodiments of the present disclosure, examples of which are illustrated in the accompanying drawings, wherein like reference numerals refer to like components throughout.

As illustrated on FIG. 1, a drying machine in accordance with an embodiment of the present disclosure includes a cabinet 10 which forms an exterior appearance, a drying drum 30 rotatably installed at an inside the cabinet 10, a driving apparatus 11 to rotate the drying drum 30, and an intake flow passage 15, an exhaust flow passage 20, and a blower apparatus 28 to circulate air to an inside the drying drum 30.

The drying drum 30 is formed in the shape of a cylindrical form having a front surface and a rear surface thereof open, and is provided with at least one lifter 60 protruded, for example, in the shape of a crest at an inner surface thereof to ascend and descend a substance to be dried. In addition, at an inner side of the cabinet 10, a front supporting panel 34 and a rear supporting panel 36 are fixedly installed at an inner side of a front surface part and an inner side of a rear surface part of the cabinet 10, respectively to rotatably support a front surface opening part and a rear surface opening part of the drying drum 30, respectively, while covering the front surface opening part and the rear surface opening part of the drying drum 30, respectively.

At a front surface of the cabinet 10 and at the front supporting panel 34, inlet openings 10*a* and 34*a* are formed such that laundry is put in or taken out of an inside the drying drum 30, and at the front surface of the cabinet 10, a door 35 is installed to open/close the inlet openings 10*a* and 34*a* as such.

The driving apparatus 11 includes a driving motor 12 installed at a lower portion of an inner side of the cabinet 10, and a pulley 13 and a rotating belt 14 configured to deliver the force of the driving motor 12 to the drying drum 30. The rotating belt 14 is installed to be wound around an outer surface of the drying drum 30 and the pulley 14 coupled to a shaft of the driving motor 12.

The intake flow passage 15 guides outside air to an inside the drying drum 30. The intake flow passage 15 includes a lower intake duct 16 installed at a lower portion of the drying drum 30, and a rear intake duct 17 which connects an intake port 18 formed at an upper portion of the rear supporting panel 36 to the lower intake duct 16. At an inside the lower intake duct 16, a heater member 22 is installed to heat suctioned air.

An exhaust flow passage 20 guides discharge of the air that is introduced to an inside the drying drum 30. The exhaust flow passage 20 includes a front exhaust duct 24 which connects an exhaust port 23 at a lower portion of the front supporting panel 34 to an entry of the blower apparatus 28 installed at a lower portion of the drying drum 30. The exhaust flow passage 20 also includes a rear exhaust duct 25 installed at a lower portion of the cabinet 10 to allow an exit of the blower apparatus 28 to communicate with an outer portion of a rear surface of the cabinet 10.

At the front exhaust duct 24, a filter member 26 is installed to filter foreign substance, such as dust or lint, which is included in heated air that is being discharged from the drying drum 30. At an upper portion of the filter member 26, a handle part 27 is installed, so that a user may be easily able to apply force to attach/detach the filter member 26 to/from the front exhaust duct 24.

The blower apparatus 28 includes a blower fan 28*a* installed at a shaft 12*b* mounted at an opposite side to a shaft 12*a* of the driving motor 12 that drives the drying drum 30, and a blower case 28*b* connected to the front exhaust duct 24 and the rear exhaust duct 25 while surrounding the blower fan 28*a*.

When performing a drying of a clothing in a conventional manner through the structure as such, the rotation of the drying drum 30 is performed by the motion of the driving motor 12, the substance accommodated at an inside the drying drum 30 may ascend and descend according to the rotation of the drying drum 30, and by having the circulation of outside air performed toward an inside the drying drum 30, the substance at an inside the drying drum 30 may be dried in a short period of time.

With respect to the blower motion of air, moist air at an inside the drying drum 30 is discharged to an outside through the exhaust flow passage 20, and new air as much as the amount of air being discharged is introduced to an inside the drying drum 30 through the intake flow passage 15. The air being introduced through the intake flow passage 15 is heated through the heating member 22, and then is introduced to an inside the drying drum 30, and thus a substance is dried in a short period of time.

On the drawings hereinafter, the structure and the coupling structure of the lifter and the drying drum will be described.

Figure 2:
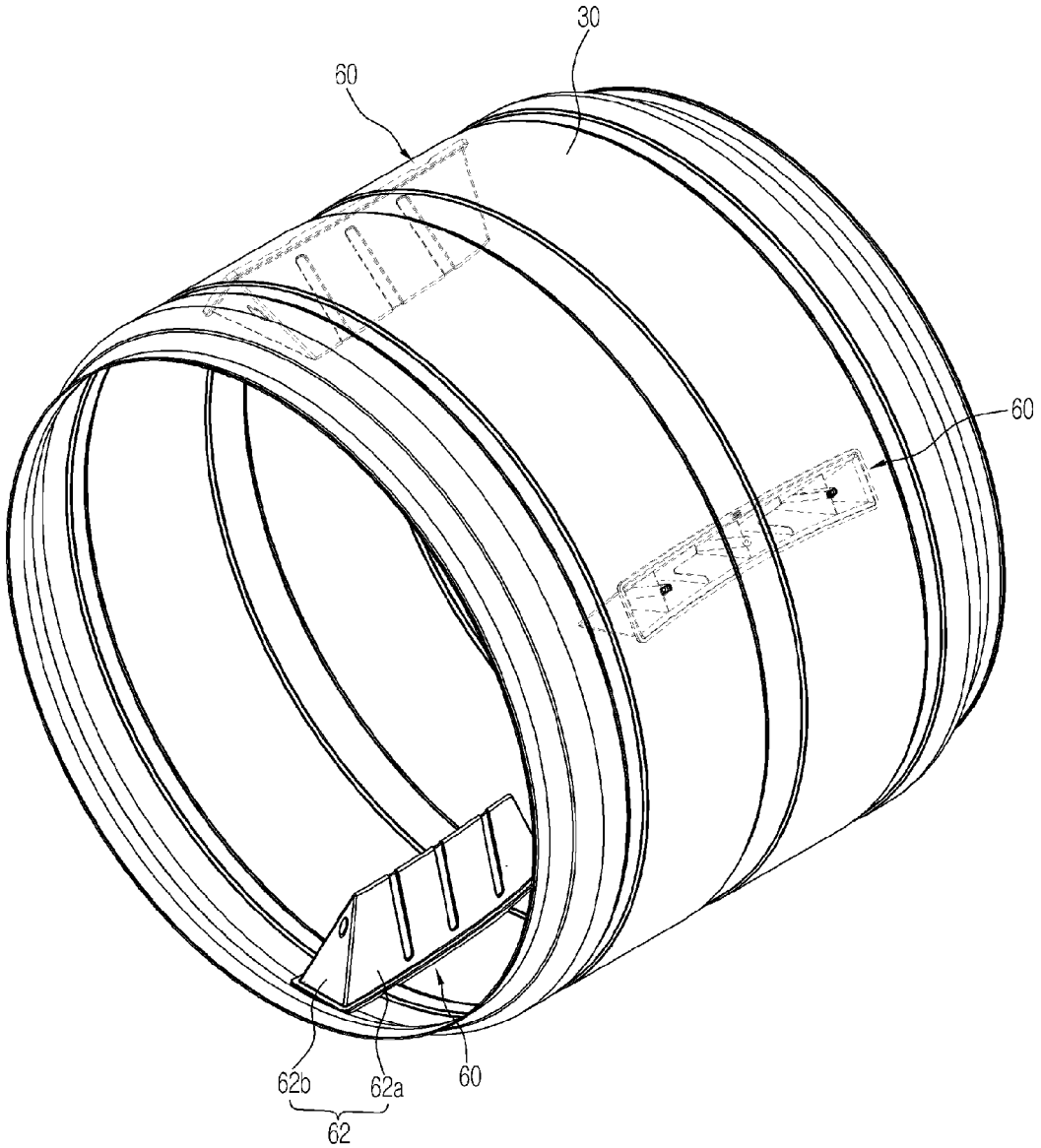
FIG. 2 is a perspective view of a drying drum of the drying machine in accordance with an embodiment of the present disclosure.
Figure 3:
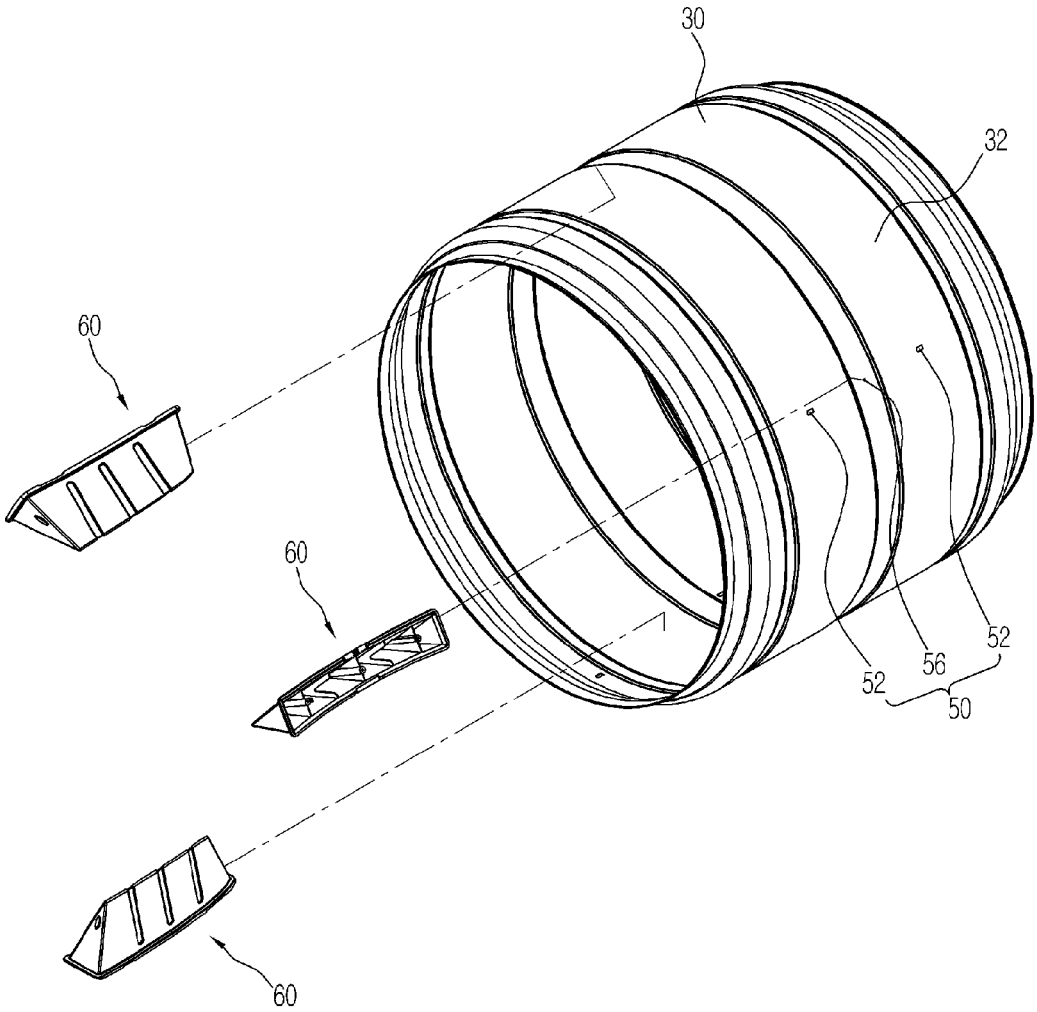
FIG. 3 is a drawing showing a coupling relation between the drying drum of the drying machine and a lifter in accordance with an embodiment of the present disclosure.
Figure 4:
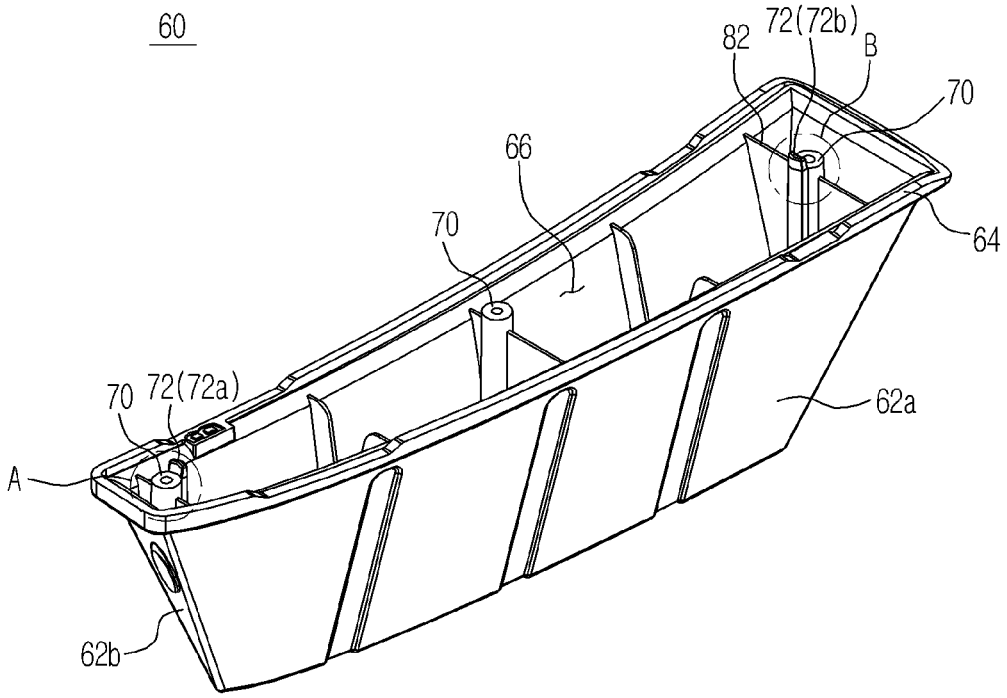
FIG. 4 is a perspective view of a lower portion the lifter in accordance with an embodiment of the present disclosure.
Figure 5A:
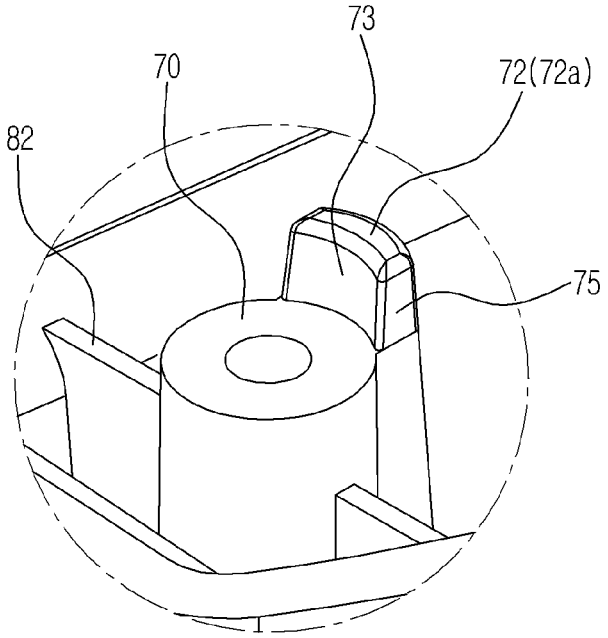
FIGS. 5A and 5B are enlarged perspective views of the portion 'A' and the portion 'B' of FIG. 4.
Figure 5B:
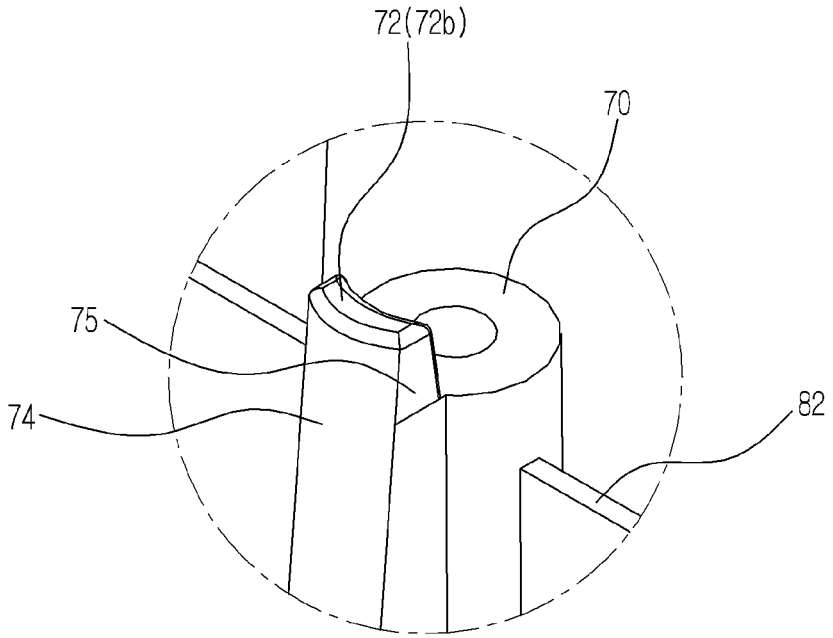
Figure 6A:
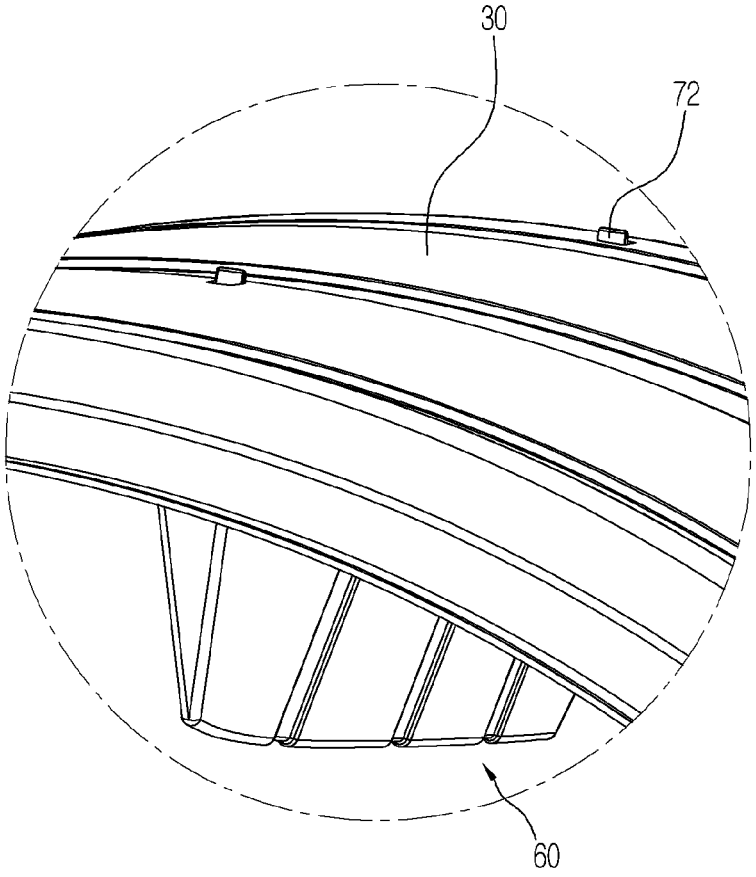
FIGS. 6A and 6B are combined perspective views of a first fixation hole and the lifter coupled to each other.
Figure 6B:
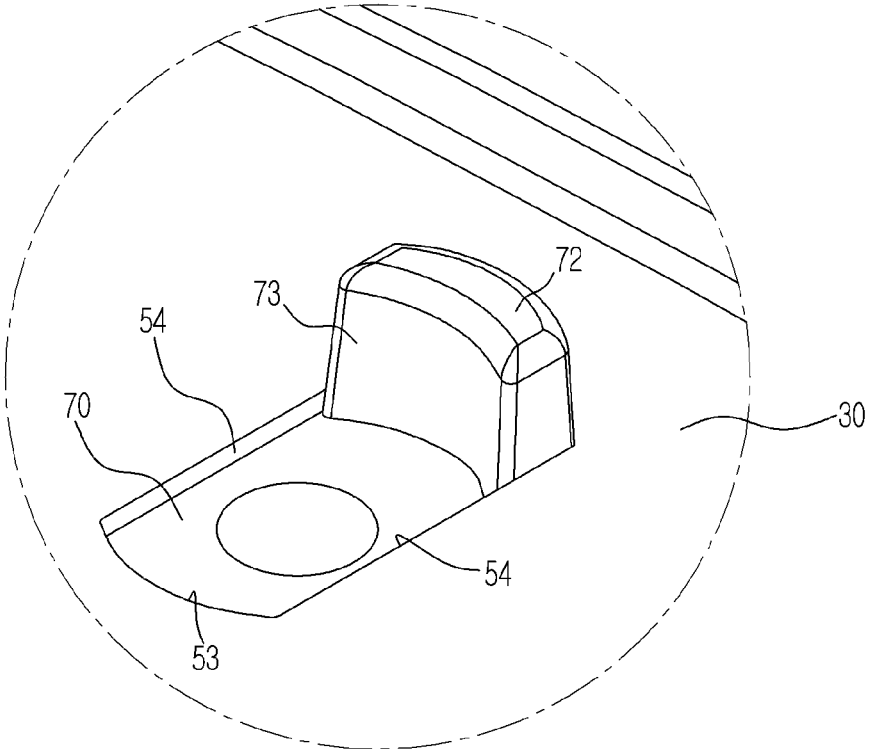
Figure 7:
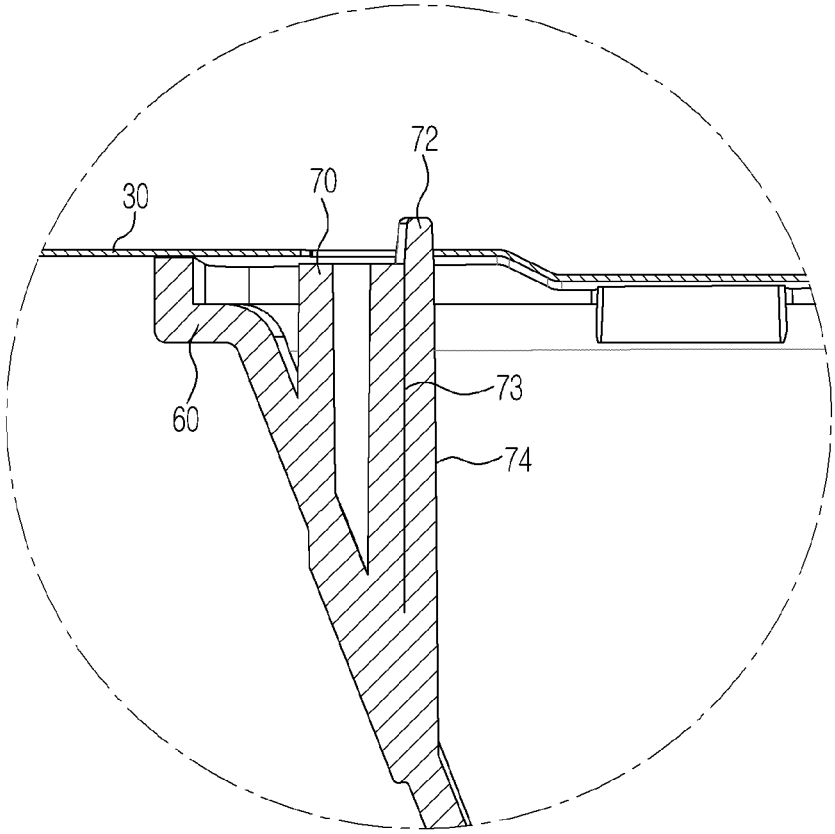
FIG. 7 is a combined cross-sectional view of the first fixation hole and the lifter coupled to each other in accordance with an embodiment of the present disclosure.
Figure 8:
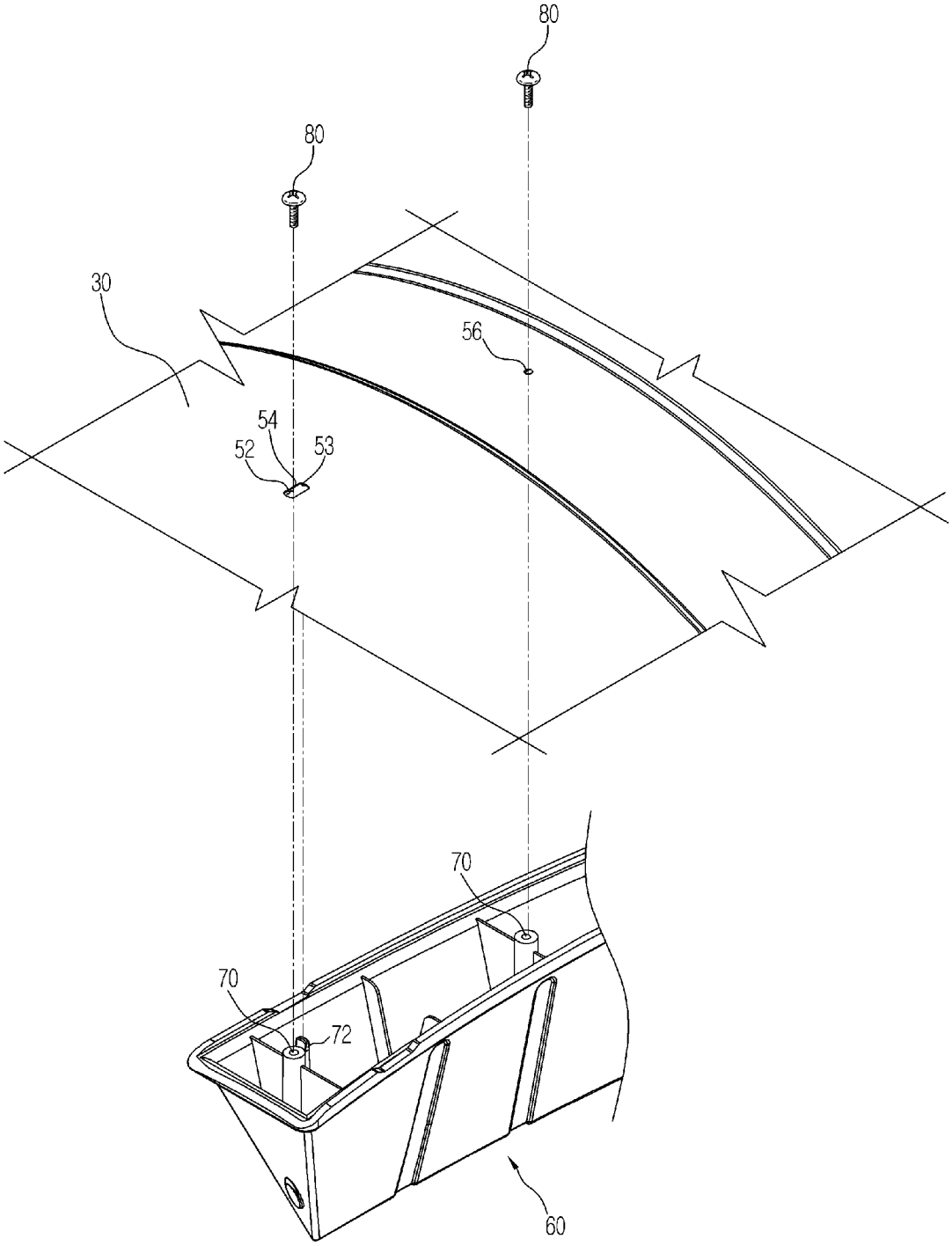
FIG. 8 is an exploded perspective view of the drying drum of the drying machine and the lifter in accordance with an embodiment of the present disclosure.

FIG. 2 is a perspective view of the drying drum of the drying machine in accordance with an embodiment of the present disclosure, FIG. 3 is a drawing showing a coupling relation between the drying drum of the drying machine and the lifter in accordance with an embodiment of the present disclosure, FIG. 4 is a perspective view of a lower portion the lifter in accordance with an embodiment of the present disclosure, FIGS. 5A and 5B are enlarged perspective views of the portion 'A' and the portion 'B' of FIG. 4, FIGS. 6A and 6B are perspective views of a first fixation hole and the lifter coupled to each other, FIG. 7 is a combined cross-sectional view of the first fixation hole and the lifter coupled to each other in accordance with an embodiment of the present disclosure, and FIG. 8 is an exploded perspective view of the drying drum of the drying machine and the lifter in accordance with an embodiment of the present disclosure.

The lifter 60 includes a body 62 which forms an exterior appearance of the lifter 60, and a border 64 which forms a lower end portion of the body 62 and provided to come into contact with an inner circumferential surface of the cylindrical part 32 of the drying drum 30 when the lifter 60 is mounted at the drying drum 30. A lower end portion of the lifter 60 is open, and an opening 66 is formed at an inner side of the border 64.

The body 62 includes two contact surfaces 62*a*, which serve to raise laundry while rotating together with the drying drum 30, and side surfaces 62*b* connected to lateral sides of the two contact surfaces 62*a*. Although only two contact surfaces 62*a* are described in an embodiment, the present disclosure is not limited thereto. For example, more than two contact surfaces may be provided to raise the laundry.

The contact surfaces 62*a* are protruded while extending in a longitudinal direction of the lifter 60. The two contact surfaces 62*a* are extended while being inclined from the border 64 to a central portion of the lifter 60 such that end portions of the contact surfaces 62*a* are adjacent to each other as the end portions of the contact surfaces 62*a* become more distant away from the border 64. Depending on the shape of the lifter 60, the end portions of the two contact surfaces 62*a* may make contact with each other, thereby allowing a tip of the lifter 60 to have a pointed shape.

The side surfaces 62*b* are provided with two end portions thereof coupled to the border 64, and are extended starting from one side surface of the body 62 to the other side surface of the body 62 while connecting the end portions of the two contact surfaces 62*a* to each other, thereby forming the body 62.

The at least one lifter 60, includes at least one coupling boss part 70 configured to be coupled to the drying drum 30, and at least one guide rib 72 protrudedly provided, for example, in the shape of a taper so as to pass through the drying drum 30 to temporarily couple the lifter 60 to the drying drum 30.

The coupling boss part 70 has an inner circumferential surface provided, for example, in the shape of a screw grooves, and an outer circumferential surface of the coupling boss part 70 provided, for example, in the shape of a cylinder, and the coupling boss part 70 is provided in at least one unit thereof and disposed to correspond to the length of the lifter 60. In detail, the coupling boss part 70 is disposed at a center of a width direction that is perpendicular to the longitudinal direction of the lifter 60, and the coupling boss part 70 is provided at least one unit thereof and disposed in the longitudinal direction of the lifter 60. Through the disposition as such, at the time when coupling the drying drum 30 to the lifter 60 by using a screw 80 (See FIG. 8), the coupling boss part 70 of the lifter 60 is disposed at a position corresponding to a fixation hole 50 of the drying drum 30 to proceed with a screw coupling.

The at least one guide rib 72, as to have the lifter 60 temporarily coupled to the drying drum 30, is protrudedly provided, for example, in the shape of a taper to penetrate the drying drum 30. The guide rib 72 is provided in the shape of a taper, and more in detail, the guide rib 72 is provided in the shape of an arc having a predetermined thickness, and is provided with a shape having the cross-sectional area thereof being reduced as the guide rib 72 becomes near to the protruded portion thereof.

As to couple the lifter 60 at the time of coupling the lifter 60 to the drying drum 30, a temporary coupling is needed. Conventionally, a hooking member is provided, or a protruding member having a cylinder is provided so as to pass through a hole, to proceed with the temporary coupling. However, in the case as the above, when performing a washing operation, a leak is occurred through a temporary fixed portion, thereby reducing washing efficiency, or the coupling of the lifter 60 may become defective. As to prevent water leak, a method of additionally attaching a sheet member to an outer circumferential surface of the drying drum 30 is used, but by proceeding with the separate material and procedure as such, the cost and effort are needlessly consumed. The guide rib 72 of the present disclosure provides a structure capable of resolving the difficulties in temporary coupling and water leak, thereby resolving the above described constraints.

The guide rib 72 may be disposed while being spaced apart from the coupling boss part 70, but the guide rib 72 may also be disposed while closely adjacent to the coupling boss part 70. The coupling boss part 70 is provided with, for example, the shape of a cylinder having screw grooves at an inner circumferential surface thereof, and the guide rib 72 is therefore provided, for example, in the shape of an arc to cover a predetermined radius of the outer circumferential surface of the coupling boss part 70. The guide rib 72 and the coupling boss part 70 may be manufactured as separate structures to each other, or the guide rib 72 may be integrally formed with the coupling boss part 70 while protruded from one portion of the coupling boss part 70.

The guide rib 72 is provided to be protruded further than the coupling boss part 70, and at the time of the coupling to the drying drum 30, the coupling boss part 70 is screw-coupled to the drying drum 30 while coming into contact with an inner circumferential surface of the drying drum 30, but the guide rib 72 is disposed while having one end portion thereof passing through the drying drum 30.

The guide rib 72 includes a guide rib inner surface part 73 that meets a predetermined radius of the coupling boss part 70, a guide rib outer surface part 74 having a cross section perpendicular to a longitudinal direction of the guide rib in an arc shape and being inclined toward the coupling boss part 70 with respect to the protruding direction, and guide rib side surface parts 75 provided at both sides of the guide rib 72 to connect the guide rib inner surface part 73 to the guide rib outer surface part 74.

The guide rib inner surface part 73 is disposed to be in contact with the coupling boss part 70, and in the case of the temporary coupling of the drying drum 30 to the lifter 60, serves as a supporter to prevent a torque from being not generated at a portion at which the guide rib 72 makes contact with an inner side surface of the lifter 60.

The guide rib outer surface part 74 is disposed at an outer side of the guide rib inner surface part 73 as far as the thickness of the guide rib 72, and with respect to the protruding direction of the guide rib 72, the guide rib outer surface part 74 is provided to be inclined toward the coupling boss part 70. The guide rib outer surface part 74 is in contact with a first fixation hole 52 of the drying drum 30, which will be described later, and at this time, the guide rib outer surface part 74 is provided in an inclined manner toward the coupling boss part 70 with respect to the protruding direction of the guide rib 72, and thus comes into close contact with one side surface of the first fixation hole 52 in a sliding manner.

The guide rib 72 is provided in at least one unit thereof at an inner side of the lifter 60, that is, adjacent to the opening 66, however, the guide rib 72 may be provided in plural numbers so as to be benefit for a temporary coupling. In the present embodiment, a first guide rib 72*a*, which is disposed adjacent to the front supporting panel 34 of the drying drum 30, and a second guide rib 72*b*, which is disposed adjacent to the rear supporting panel 36 of the drying drum 30, are provided at the drying drum 30 having the lifter 60, and thus the total of two units of the guide ribs 72 are disposed. However, the number of the guide ribs 72 is not limited hereto.

The first guide rib 72*a* and the second guide rib 72*b* are disposed at opposite sides in the longitudinal direction of the lifter 60. The first guide rib 72*a* and the second guide rib 72*b* are disposed to make contact with the coupling boss parts 70 disposed along the longitudinal direction of the lifter 60, while allowing the guide rib outer surface parts 74 thereof to face each other. Since the guide rib outer surface parts 74 are disposed at opposite directions in the longitudinal direction of the lifter 60, both sides of the lifter 60 may be able to be supported against the drying drum 30, so that a temporary coupling may be achieved in the case of coupling to the drying drum 30. However, the present disclosure is not limited thereto. The guide rib outer surface parts 74 may not face each other but provided in a same direction in the longitudinal direction of the lifter 60. Further, the guide rib inner surface parts 73 may be provided to face each other. In detail, in the case of coupling the lifter 60 to the drum 30, the guide rib outer surface parts 74 of the first guide rib 72*a* and the second guide rib 72*b* come into contact with the first fixation holes 52 of the drying drum 30 in a sliding manner, and since the first guide rib 72*a* and the second guide rib 72*b* are provided with a taper shape having a cross-section thereof decreasing toward the protruded portion thereof. Accordingly, if a certain portion of the guide rib 72 is protruded, the guide rib 72 is no longer inserted. Through the above, the both sides of the lifter 60 are supported, and thus a temporary coupling is achieved before the screw coupling.

At an inside the lifter 60 formed by the two contact surfaces 62*a* and the two side surfaces 62*b*, a plurality of ribs 82 are formed along the width direction of the lifter 60. The rib 82 may be disposed perpendicular to the longitudinal direction of the lifter 60, so that the lifter 60 is provided with adequate strength even if the inside of the lifter 60 is empty. The rib 82 may be disposed at an inside the lifter 60, for example, may be disposed on the same line as the coupling boss part 70.

At the cylindrical part 32 of the drying drum 30, a plurality of fixation holes 50 is formed in a way to be parallel to the axis direction of the cylindrical part 32, and the structure as such is provided for the lifter 60 and the drying drum 30 to be coupled to each other through the guide rib 72.

The fixation hole 50 includes a first fixation hole 52 to which the coupling boss part 70 provided with the guide rib 72 disposed thereto, and a second fixation hole 56 to which only the coupling boss part 70 is coupled.

The first coupling hole 52 is referred to as the fixation hole 50 to which the coupling boss part 70 that the guide rib 72 is in contact with, and includes a locking connection part 53 that is in contact with the guide rib outer surface part 74, and coupling connection parts 54 that are configured to face each other in a parallel manner while being in contact with the guide rib side surface parts 75. The locking connection part 53 is referred to as a portion making contact with the guide rib outer surface part 74 of the guide rib 72 at the time when the lifter 60 is temporarily coupled to the drying drum 30. The locking connection part 53 is provided in an arc shape and disposed at one side of the first fixation hole 52 such that the locking connection part 53 makes contact with the guide rib outer surface part 74. That is, the locking connection part 53 is disposed at a position corresponding to the guide rib outer surface part 74. As a sliding insertion at the guide rib outer surface part 74*a* allows the guide rib outer surface part 74*a* and the locking connection part 53 to come into close contact with each other, thereby preventing a water leak from the inside the drying drum 30. Through such, no separate sheet member is needed to be attached after the coupling, and thus the cost of material and manufacturing may be reduced.

The coupling connection part 54 is referred to as a portion of the first fixation hole 52 except for the locking connection part 53, and is also referred to a space configured to couple the screw 80 from an outer circumferential surface of the drying drum 30 to the coupling boss part 70 of the lifter 60, when the coupling boss part 70 of the lifter 60 comes into close contact with the inner circumferential surface of the drying drum 30 at the time of coupling of the lifter 60 to the drying drum 30.

The second fixation hole 56 is referred to as a fixation hole to which only the coupling boss part 70 is coupled, and is provided with a diameter smaller than ahead part of the screw 80 and the coupling boss part 70 and larger than a thread of the screw 80.

The number of the lifters 60 is not limited, but in an embodiment of the present disclosure, the three units of the lifters 60 are disposed while spaced apart from one another at the same interval in a circumferential direction on a rotating shaft of the drying drum 30.

Hereinafter, a method of assembling the lifter 60 to the drying drum 30 of the drying machine 1 in accordance with the structure above will be described.

As to assemble the lifter 60 to the drying drum 30, the first guide rib 72*a* and the second guide rib 72*b* provided adjacent to the opening 66, that is, at the inner side of the lifter 60, are pushed into the plurality of locking connection parts 53 of the first fixation holes 52. Since the first guide rib 72*a* and the second guide rib 72*b* have the guide rib outer surface parts 74 facing each other to support the both sides of the lifter 60, a temporary coupling is proceeded without being separated.

In the state as such, by coupling the coupling boss part 70, which comes into close contact with the inner circumferential surface of the drying drum 30, by use of the screw 80 through the coupling connection part 54 of the first fixation hole 52, the drying drum 30 and the lifter 60 are coupled to each other.

As for the lifter 60 coupled as such, the guide rib 72 and the coupling boss part 70, which have been subject to the temporary coupling, come into close contact with the drying drum 30, and thus no leak is occurred through the close contact portion. Furthermore, in addition to the screw coupling, the coupling by way of the guide rib 72 prevents vibration from occurring due to the rotation of the drying drum 30, so that the coupling efficiency is improved.

In an embodiment of the present disclosure, only the descriptions with respect to the drying drum of the drying machine are provided, but in the case of a cloth drying machine, the structure thereof is identical to the structure of the drying drum of the drying machine, and thus the structure of the lifter 60 may also be applicable to the cloth drying machine.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drying machine, comprising:

a cabinet;

a drying drum disposed at an inside the cabinet to accommodate a laundry, and configured to rotate by receiving rotating force from a driving source; and at least one lifter provided at an inner circumferential surface of the drying drum, and configured to have the laundry move at an inside the drying drum, wherein the at least one lifter comprises:

at least one coupling boss part configured to be coupled to the drying drum by receiving a fastening member; and at least one guide rib protrudedly provided to pass through the drying drum so as to temporarily couple the at least one lifter to the drying drum, and wherein the drying drum is provided with a fixation hole to be coupled to the at least one lifter.

2. The drying machine of claim 1, wherein:

the at least one guide rib is provided in a shape of a taper.

3. The drying machine of claim 1, wherein:

the at least one guide rib is protrudedly formed to be temporarily coupled to the drying drum while being inserted into the drying drum prior to the at least one coupling boss part.

4. The drying machine of claim 1, wherein:

the at least one guide rib is provided in the shape of an arc of the at least one coupling boss part to cover a predetermined radius of the at least one coupling boss part.

5. The drying machine of claim 1, wherein:

the at least one guide rib is further protruded than the at least one coupling boss part.

6. The drying machine of claim 1, wherein:

the at least one guide rib comprises a guide rib inner surface part that makes contact with a predetermined radius of the at least one coupling boss part, and a guide rib outer surface part having a cross-section perpendicular to a longitudinal direction of the at least one guide rib in an arc shape and being inclined toward the at least one coupling boss part with respect to a protruded direction of the at least one guide rib.

7. The drying machine of claim 4, wherein:

the at least one guide rib further comprises a guide rib side surface part to connect the guide rib inner surface part to the guide rib outer surface part.

8. The drying machine of claim 1, wherein:

the at least one guide rib comprises a first guide rib and a second guide rib, and the first guide rib and the second guide rib are disposed while being spaced apart from each other along a longitudinal direction of the at least one lifter.

9. The drying machine of claim 8, wherein:

the first guide rib and the second guide rib are disposed at opposite sides to each other with respect to a center of the at least one lifter.

10. The drying machine of claim 8, wherein:

the first guide rib and the second guide rib are respectively disposed at end portions of the at least one lifter in a longitudinal direction of the at least one lifter.

11. The drying machine of claim 1, wherein:

the at least one coupling boss part is spaced apart from each other in a longitudinal direction of the at least one lifter, starting from a middle of a width direction of the at least one lifter.

12. The drying machine of claim 1, wherein:

the fixation hole comprises a first fixation hole to which the at least one guide rib is coupled, and a second fixation hole to which the at least one coupling boss part is coupled.

13. A drying machine, comprising:

a cabinet; and a drying drum disposed at an inside the cabinet, and configured to rotate by receiving rotating force from a driving source, wherein the drying drum comprises:

a cylindrical part; and at least one lifter formed at an inner circumferential surface of the cylindrical part in a direction parallel to a driving shaft so as to have laundry move according to a rotation of the drying drum, and wherein the at least one lifter comprises:

at least one coupling boss part configured to be coupled to the drying drum;

at least one guide rib protrudedly provided to pass through the drying drum while being integrally formed with one side of the at least one coupling boss part so as to temporarily couple the at least one lifter to the drying drum; and a first fixation hole provided at the cylindrical part to couple with the coupling boss part and to temporary fix the at least one guide rib.

14. The drying machine of claim 13, further comprising:

a second fixation hole configured to couple with the at least one coupling boss part.

15. The drying machine of claim 14, wherein:

the first fixation hole and the second fixation hole are disposed in alignment with each other on the cylindrical part.

16. The drying machine of claim 14, wherein:

the first fixation hole and the second fixation hole are alternately disposed on the cylindrical part.

17. The drying machine of claim 14, wherein:

the first fixation hole and the second fixation hole are disposed at different sizes from each other.

18. The drying machine of claim 13, wherein:

the at least one guide rib is provided in a shape of an arch of the at least one coupling boss part to cover a predetermined radius of the at least one coupling boss part.

19. The drying machine of claim 13, wherein:

the at least one guide rib is further protruded than the at least one coupling boss part.

20. The drying machine of claim 13, wherein:

the at least one guide rib comprises a guide rib inner surface part that makes contact with a predetermined radius of the coupling boss part, and a guide rib outer surface part having a cross-section perpendicular to a longitudinal direction of the guide rib in an arc shape and being inclined toward the coupling boss part with respect to a protruded direction of the guide rib.

21. The drying machine of claim 20, wherein:

the at least one guide rib further comprises a guide rib side surface part to connect the guide rib inner surface part to the guide rib outer surface part.

22. The drying machine of claim 20, wherein:

the first fixation hole comprises:

a locking connection part to close contact with the at least one lifter to fix the at least one lifter; and a coupling connection part to close contact with the drying drum while allowing the at least one coupling boss part to be coupled thereto.

23. The drying machine of claim 22, wherein:

the locking connection part is provided in a shape of an arc to close contact with the guide rib outer surface part.

24. The drying machine of claim 22, wherein:

the at least one coupling boss part is screw-coupled and close contact with the coupling connection part.

* * * * *